US010976128B2

(12) United States Patent
LaMons et al.

(10) Patent No.: US 10,976,128 B2
(45) Date of Patent: Apr. 13, 2021

(54) ROUND COUNTING SIMULATION MAGAZINE

(71) Applicant: FAAC Incorporated, Ann Arbor, MI (US)

(72) Inventors: Jason W. LaMons, Pine, CO (US); Michael G. Snow, Erie, CO (US); Daniel P. Bryce, Bountiful, UT (US)

(73) Assignee: FAAC Incorporated, Ann Arbor, MI (US)

( * ) Notice: Subject to any disclaimer, the term of this patent is extended or adjusted under 35 U.S.C. 154(b) by 393 days.

(21) Appl. No.: 16/000,504

(22) Filed: Jun. 5, 2018

(65) Prior Publication Data

US 2018/0356175 A1 Dec. 13, 2018

Related U.S. Application Data

(60) Provisional application No. 62/515,006, filed on Jun. 5, 2017.

(51) Int. Cl.

| | |
|---|---|
| ***F41A 33/06*** | (2006.01) |
| ***F41A 99/00*** | (2006.01) |
| ***F41A 19/01*** | (2006.01) |
| ***F41A 9/61*** | (2006.01) |
| ***F41A 9/64*** | (2006.01) |
| ***F41A 33/00*** | (2006.01) |

(52) U.S. Cl.

CPC ..... *F41A 33/06* (2013.01); *F41A 9/61* (2013.01); *F41A 9/64* (2013.01); *F41A 19/01* (2013.01); *F41A 33/00* (2013.01); *F41A 99/00* (2013.01)

(58) Field of Classification Search

CPC ..... F41G 3/26; F41G 3/2622; F41A 19/01; F41A 33/00; F41A 33/06; F41A 9/61

See application file for complete search history.

(56) References Cited

U.S. PATENT DOCUMENTS

| | | | | |
|---|---|---|---|---|
| 5,299,374 | A * | 4/1994 | Mathys | F41A 19/10 42/69.01 |
| 8,016,594 | B2 | 9/2011 | Ferris et al. | |
| 8,267,691 | B1 | 9/2012 | Ferris et al. | |
| 8,360,776 | B2 | 1/2013 | Manard et al. | |
| 9,182,189 | B2 * | 11/2015 | Seigler | F41A 33/00 |
| 2008/0078369 | A1 * | 4/2008 | Yeung | F41B 11/681 124/67 |
| 2012/0129136 | A1 | 5/2012 | Dvorak | |
| 2013/0108991 | A1 | 5/2013 | Walls | |
| 2017/0146311 | A1 * | 5/2017 | Tucker | F41A 19/53 |

* cited by examiner

*Primary Examiner* — James S. McClellan
(74) *Attorney, Agent, or Firm* — Quinn IP Law

(57) ABSTRACT

A simulated magazine useful to provide for simulated firing of a firearm includes a cycling lever arm which is depressed once every time the firearm is cycled; a linearly shaped counting plunger; a plunger spring biasing the plunger in an upward position; and a spring assembly connected to the cycling lever arm and acting upon the plunger. Depression of the cycling lever arm causes the plunger to move incrementally upward. When the plunger is in a fully up state, a slide catch trigger extends upward from the magazine, the slide catch trigger causing a slide of the firearm to remain in a back, open state.

13 Claims, 10 Drawing Sheets

ROUND COUNTING SIMULATION MAGAZINE

CROSS REFERENCE TO RELATED APPLICATIONS

This disclosure claims the benefit of U.S. Provisional Application No. 62/515,006 filed on Jun. 5, 2017, which is hereby incorporated by reference.

TECHNICAL FIELD

This disclosure is related to a device useful for tactical simulations using real firearms, and, in particular, to a replacement magazine that permits use of an otherwise functional firearm to perform a tactical simulation, wherein the magazine retains the slide in an open position when a last simulated round has been fired.

BACKGROUND

The statements in this section merely provide background information related to the present disclosure. Accordingly, such statements are not intended to constitute an admission of prior art.

Tactical simulations are known wherein a policeman or other person is presented with images, and in some cases the person is required to perform a simulated firing of a firearm when the images call for such an action. The images can be projected upon a screen or other display device and simulate a stressful, dangerous situation that the person may find themselves in the real world. Compressed air or $CO_2$ are sometimes used to simulate cycling of the firearm. In other embodiments, nitrogen and green gas (lubricated propane) are used as propellants useful for simulating the cycling of the firearm.

SUMMARY

A simulated magazine useful to provide for simulated firing of a firearm includes a cycling lever arm which is depressed once every time the firearm is cycled; a linearly shaped counting plunger; a plunger spring biasing the plunger in an upward position; and a spring assembly connected to the cycling lever arm and acting upon the plunger. Depression of the cycling lever arm causes the plunger to move incrementally upward. When the plunger is in a fully up state, a slide catch trigger extends upward from the magazine, the slide catch trigger causing a slide or bolt carrier of the firearm to remain in a back, open state.

BRIEF DESCRIPTION OF THE DRAWINGS

One or more embodiments will now be described, by way of example, with reference to the accompanying drawings, in which.

DETAILED DESCRIPTION

Figure 3:
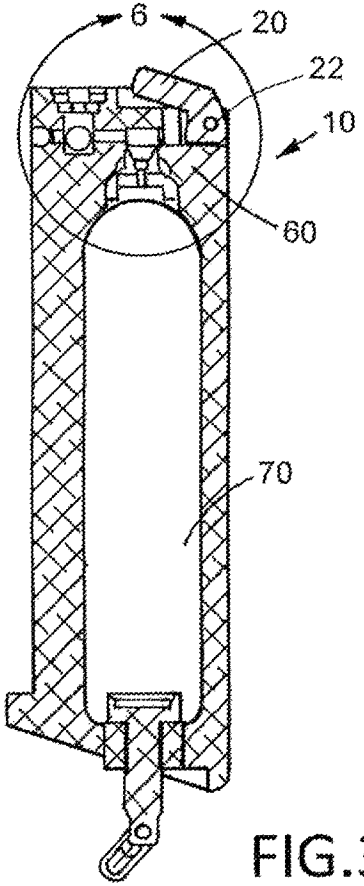
FIG. 3 illustrates the simulation magazine of FIG. 1 in side view cross section, in accordance with the present disclosure.

A simulation magazine for use in a pistol or other firearm is provided, enabling an otherwise functional firearm to be used in a training exercise. The simulation magazine can include a carbon dioxide ($CO_2$) gas canister capable of supplying a pressurized gas useful for simulating firing of the firearm. The simulation magazine can further include a valve and control mechanisms useful to enabling complete simulation of the firing of the firearm without further modification of the firearm—the compressed gas and control mechanisms contained within the simulation magazine, when inserted within the magazine cavity of the firearm, provide full functionality to cycle the firearm based upon the user pulling the trigger of the firearm. This operation is exemplary, and other options and alternative configurations, such as use within a dedicated simulation firearm and/or pressurized gas being supplied by an air hose can similarly be utilized with the disclosed simulation magazine.

The round counting magazine described herein is useful in a wide variety of firearms. In one embodiment, the disclosed device is useful in a semi-automatic pistol, such as a Glock® 19 or a Sig Sauer P320. Such firearms include a lower receiver which includes both a trigger mechanism and a magazine cavity. Such firearms also include a slide which includes a barrel including a chamber, a hammer or striker mechanism, and a firing pin mechanism. During normal firing of such a firearm, the slide is initially in a fully forward position. The firing of a round causes the slide to move backward along an upper surface of the lower receiver into a fully backward position. If a new round is present in the magazine, the slide moves forward back into forward position, moving the new round into the chamber. If no round is present in the magazine, the slide stays in an open state somewhere close to but slightly forward of the fully backward position.

Simulations of tactical situations are more useful when they are realistic. Actual firing of a firearm is only possible when a round is present within the chamber of the firearm. The supply of available rounds in the firearm is limited based upon the magazine capacity of the firearm. Further, a magazine can have an only partial filled magazine. The disclosed simulation magazine provides a round counting mechanism useful to enable a limited number of firing simulation cycles of the firearm.

The disclosed simulation magazine permits the slide to fully cycle through a number of simulated firing cycles until a particular count of cycles have occurred. Once the desired number of simulated firing cycles have occurred, a slide catch trigger extends upwardly from the simulation magazine, holding the slide in the open position to simulate normal operation of the firearm when no rounds are present in the magazine.

The disclosed simulation magazine can include a round count simulation limiter, enabling an instructor or user to pre-select how many rounds are permitted to be simulated in a particular simulation.

Figure 1:
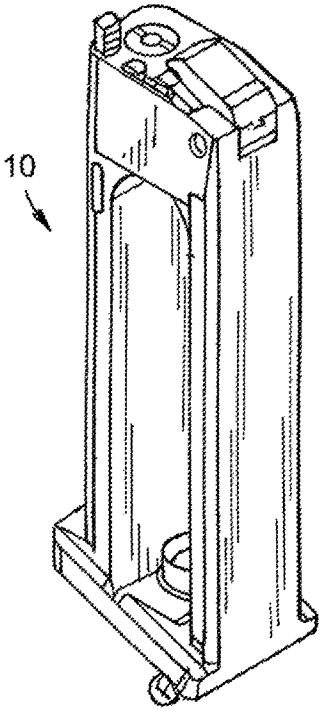
FIG. 1 illustrates an exemplary simulation magazine in perspective view, in accordance with the present disclosure.

Referring now to the drawings, wherein the showings are for the purpose of illustrating certain exemplary embodiments only and not for the purpose of limiting the same, FIG. 1 illustrates an exemplary simulation magazine in perspective view. Simulation magazine 10 is illustrated as a device generally shaped like an operational magazine designed for a particular handgun which stores and provides a stack of bullets or rounds to the firing mechanism of the firearm. Simulation magazine 10 fits similarly within a magazine cavity of the firearm and enables use of the firearm as or within a tactical simulation. Simulation magazine 10 is pictured for use with an exemplary handgun. It will be appreciated that with minor modifications, the magazine could be made for use with various brands of semi-automatic handguns or rifles. In some embodiments of the present application, a replacement simulation barrel for handguns or a replacement bolt for rifles can be used for some improvements to functionality, although the disclosure is not intended to be limited to particular embodiments of simulation equipment.

Figure 2:
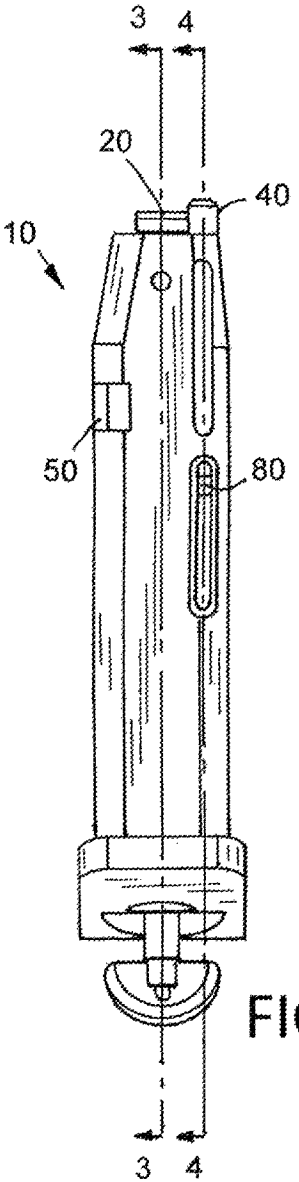
FIG. 2 illustrates the simulation magazine of FIG. 1 in front plan view, in accordance with the present disclosure.
Figure 4:
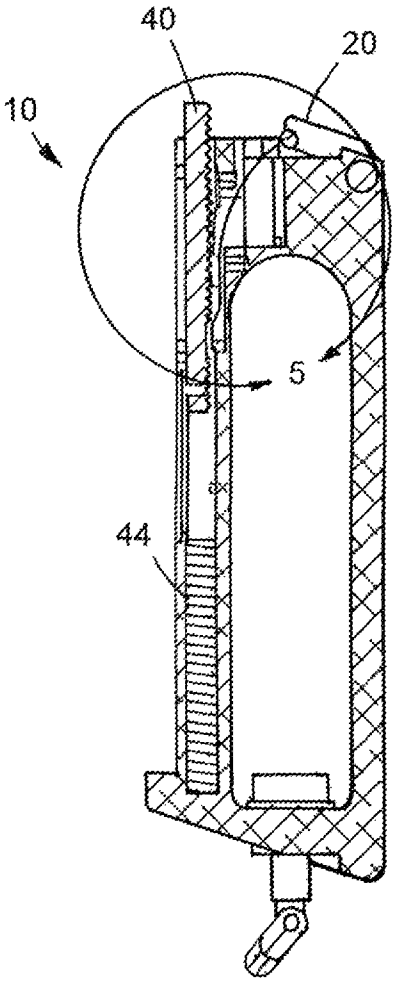
FIG. 4 illustrates the simulation magazine of FIG. 1 in side view cross section, in accordance with the present disclosure.

FIG. 2 illustrates the simulation magazine of FIG. 1 in front plan view. Simulation magazine 10 is illustrated. Cross section labels are provided illustrating the sections that are illustrated in FIGS. 3 and 4, respectively. Cycling lever arm 20 is illustrated as a pivoting lever that interacts with the slide of the firearm or details that are attached to the slide. When the slide cycles with a simulated firing of the weapon, details of the slide or details attached to the slide press down on lever arm 20. Lever arm 20 is connected to a spring assembly within the simulation magazine, and the depression of lever arm 20 cycles the spring assembly and round counting plunger 40 to simulate the expense of one round from the magazine 10. Magazine release detail 50 interacts with a magazine release mechanism on the handgun or rifle to permit selective retention and release of the magazine 10 to and from the firearm. Round counting plunger 40 is spring biased in an up position. In a fully up position, round counting plunger 40 holds the slide or bolt of the firearm in an open position, similar to an open position in which slides are configured on most semi-automatic handguns to remain after a last round is fired from an operational magazine. Plunger depression button 80 permits a user to easily counter the action of the plunger spring and return plunger 40 to a down position. In some embodiments, the plunger 40 does not directly contact the slide itself, but rather engages the weapon's natural side stop lever which then engages and holds open the slide.

Throughout the disclosure, language is directed to a magazine for use in a firearm. It will be appreciated that the simulation magazines described herein can be used similarly in either handguns or rifles with similar or the same technology being useful for the described purposes. In any instance of the disclosure, the slide catch useful to hold the slide of a handgun in an open state can similarly be used in a rifle to hold a bolt or bolt carrier mechanism in a rearward or open state. In such an embodiment, the slide catch of the various figures can be described as a bolt catch.

Plunger 40 can directly contact the slide of the firearm. However, in many embodiments, plunger 40 engages components that in turn engage the slide. In all instances in the disclosure, the plunger 40, the slide catch trigger as part of plunger 40, and all variations thereof should be read to either engage the slide, engage details of the slide or attached to the slide, or engage components of the firearm that in turn engage the slide. In any effect, the extension of plunger 40 above the top of the disclosed magazine results in the slide of the firearm remaining backward in an open state.

Embodiments of the present disclosure include a linear round counting plunger comprising a straight rod with a number of round counting teeth formed into the rod. Such a linear or straight counting mechanism is advantageous over a circular round counting mechanism with teeth upon the circular mechanism. First, the linear round counting plunger can include an end that is permitted to extend up above the simulation magazine and therefore is useful directly as a slide catch trigger. When a firearm cycles, even as a result of a gas cartridge releasing pressurized gas, the internal mechanisms of the firearm are put under considerable stress. A one piece linear plunger and slide catch trigger is more robust and has fewer moving parts than a spinning circular wheel with teeth and therefore more reliable than a circular counting mechanism that releases a separate slide catch trigger mechanism. Further, a circular mechanism and a separate slide catch trigger, including at least one and likely two axles upon which they rotate, take up considerable package space within a small simulation magazine. The disclosed linear plunger and slide catch trigger take up less space in the simulation magazine. This permits a smaller magazine, such as are required in smaller firearms, such as specialty conceal carry firearms, to be simulated.

Figure 6:
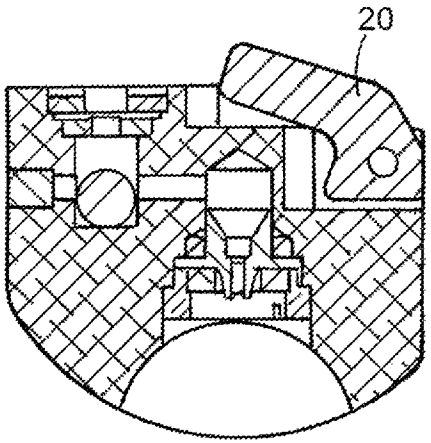
FIG. 6 illustrates a detail magnified view of FIG. 3, in accordance with the present disclosure.

FIG. 3 illustrates the simulation magazine of FIG. 1 in side view cross section. Simulation magazine 10 is illustrated. A magnified view area for FIG. 6 is illustrated. Cycling lever arm 20 is illustrated including a pin pivot point 22 at its base. Valve mechanism 60 is illustrated including passages and at least one valve to receive pressurized gas from gas chamber 70 and provide the pressurized gas to the rest of the firearm as a simulated round, cycling the slide of the firearm. Chamber 70 can include a $CO_2$ cartridge or can be a self-contained chamber that can be pressurized. The $CO_2$ cartridge or storage tank can be removable or refillable. As noted herein, a simulated barrel or bolt can be used in combination with the described gas simulation system. The valve mechanisms and pressurized gas systems disclosed herein are exemplary. Other versions or embodiments of gas release systems can be used with a simulation magazine and simulation firearm, and the disclosure is not intended to be limited to the particular exemplary embodiments provided herein.

Figure 5:
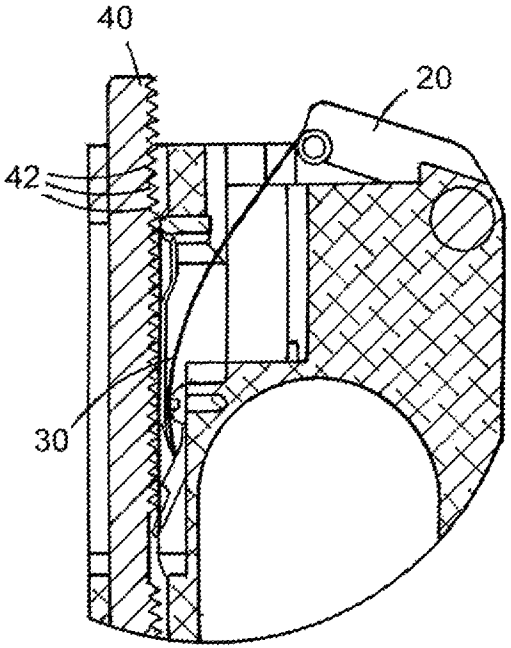
FIG. 5 illustrates a detail magnified view of FIG. 4, in accordance with the present disclosure.

FIG. 4 illustrates the simulation magazine of FIG. 1 in side view cross section. Simulation magazine 10 is illustrated. A magnified view area for FIG. 5 is illustrated. Cycling lever arm 20 is illustrated. Round counting plunger 40 is illustrated including slide catch trigger 43 and plunger spring 44. Plunger spring 44 and plunger 40 are mechanically connected, such that force applied by spring 44 biases plunger 40 in an upward direction. Plunger 40 is illustrated in a fully up position, with slide catch trigger 43 exposed above a top of magazine 10.

FIG. 5 illustrates a detail magnified view of FIG. 4. Plunger 40 includes teeth 42. Spring assembly 30 includes a plurality of springs attached to lever arm 20 and configured to cycle with the teeth 42 of plunger 40. One depression of lever arm 20 results in the plunger moving upward according to one tooth advancement of plunger 40.

FIG. 6 illustrates a detail magnified view of FIG. 3. Cycling lever arm 20 is illustrated as well are exemplary valve mechanism details. Any known valving mechanism useful for selectively releasing a pulse of compressed gas from a gas chamber useful to cycle a simulated round in the firearm. One exemplary non-limiting valve configuration can include a poppet valve design. Another exemplary non-limiting valve configuration can include a ball-valve design.

Figure 7:
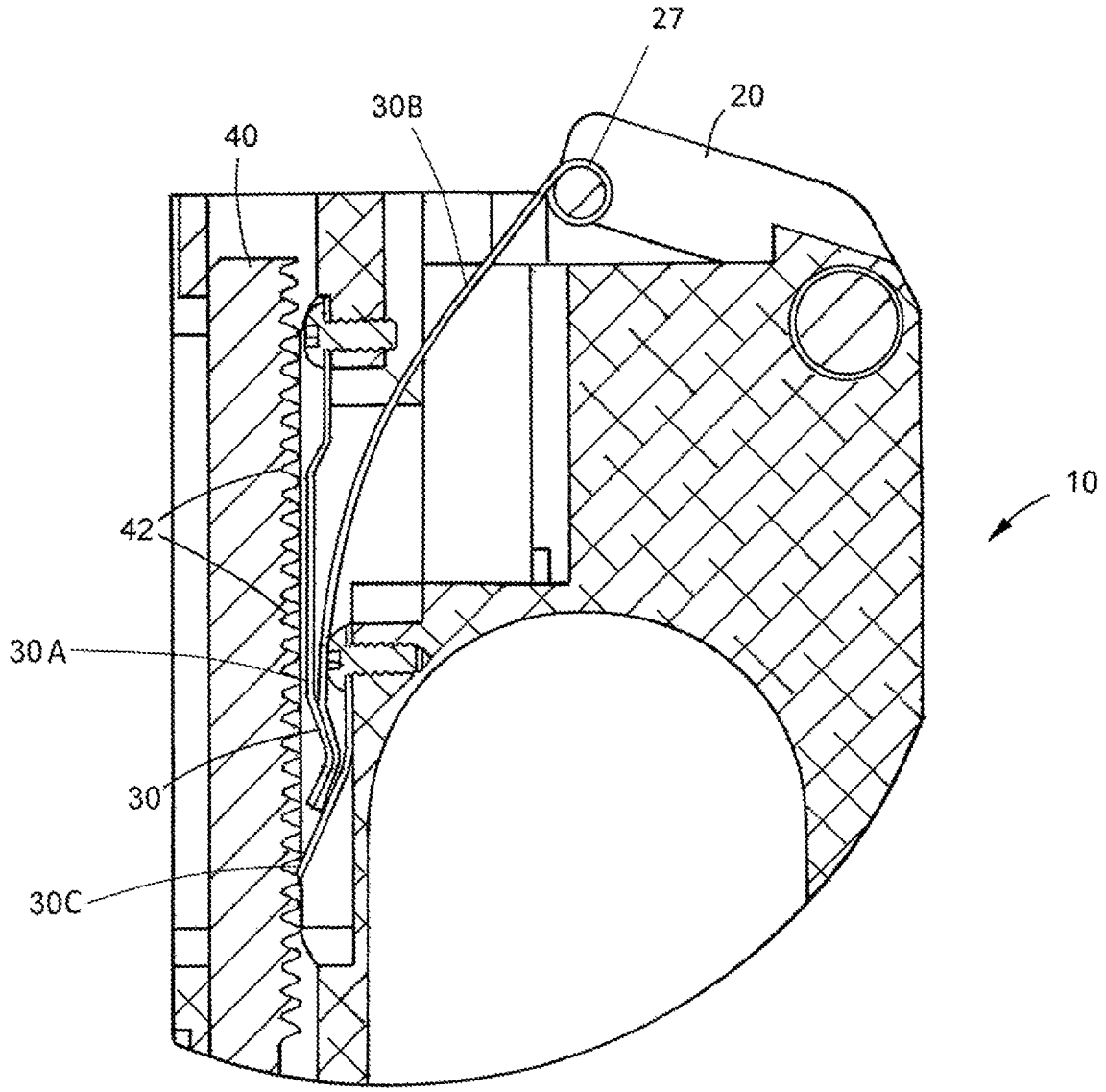
FIG. 7 illustrates the detail magnified view of FIG. 5 in greater detail, in accordance with the present disclosure.

FIG. 7 illustrates the detail magnified view of FIG. 5 in greater detail. Spring assembly 30 includes a plurality of springs attached to lever arm 20 and configured to cycle with the teeth 42 of plunger 40. One depression of lever arm 20 results in the plunger moving upward according to one tooth advancement of plunger 40. Plunger 40 is illustrated in a down or retracted state, such that the end of plunger 40 does not yet extend upward to act as a slide catch trigger.

Spring assembly 30 of FIG. 7 is illustrated including springs 30A, 30B, and 30C. Metal springs 30A and 30C are each anchored to the stable housing of magazine 10. Ends of each of springs 30A and 30C distal from their anchored ends are able to bend or flex depending upon a flexibility of the springs. Spring 30B is attached to lever arm 20 at post 27 at one end and is sandwiched between the two other springs at a second end. When lever arm 20 is depressed, it provides a thrusting force along a longitudinal direction of spring 30B, pushing it downward between springs 30A and 30C. This thrusting force applied to spring 30B forces the flexing end of spring 30A to the left on FIG. 7 and forces the flexing end of spring 30C down and to the right on FIG. 7. The movement of these flexing ends achieves the movement of plunger 40 as described herein. In one embodiment, spring 30A can be described as a first spring of the spring assembly, spring 30B can be described as a second spring of the spring assembly, and spring 30C can be described as a third spring of the spring assembly.

FIGS. 8-11 illustrate springs of a spring set interacting with teeth of a round counting plunger through a firing cycle. FIGS. 8-11 are in order, showing from beginning to end, a cycle of simulated firing resulting in the plunger moving upward a distance of one spacing of the teeth of the plunger. Spring assembly 30 of FIG. 7 is illustrated including springs 30A, 30B, and 30C. Spring 30B is attached to cycling lever arm 20 of FIG. 7, and when lever arm 20 is depressed, it interacts with springs 30C and 30A, first dislodging spring 30C from a tooth, thereby permitting the plunger spring to move the plunger upward. Spring 30A then catches and retains a proximate tooth, thereby ceasing an upward advance of the plunger. Spring 30C is then reseated with a proximate tooth, and the cycle completes.

Figure 8:
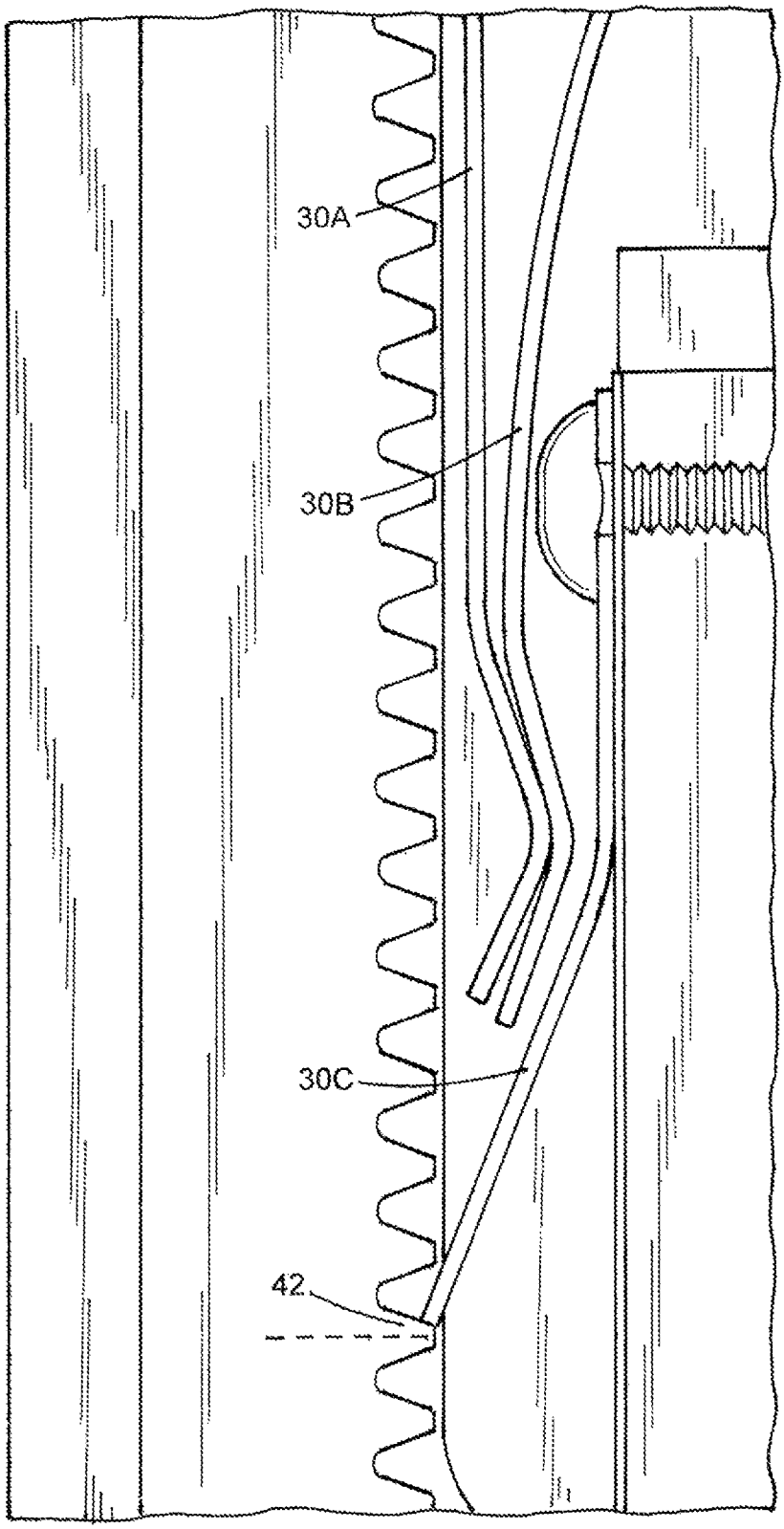
FIGS. 8-11 illustrate springs of a spring set interacting with teeth of a round counting plunger through a firing cycle, in accordance with the present disclosure.

FIG. 8 illustrates springs 30A, 30B, and 30C in initial positions with the connected lever arm in an undepressed state. One of teeth 42 are indexed with a dotted line for purpose of illustration only, showing the movement of that indexed tooth through FIGS. 8-11.

Figure 9:
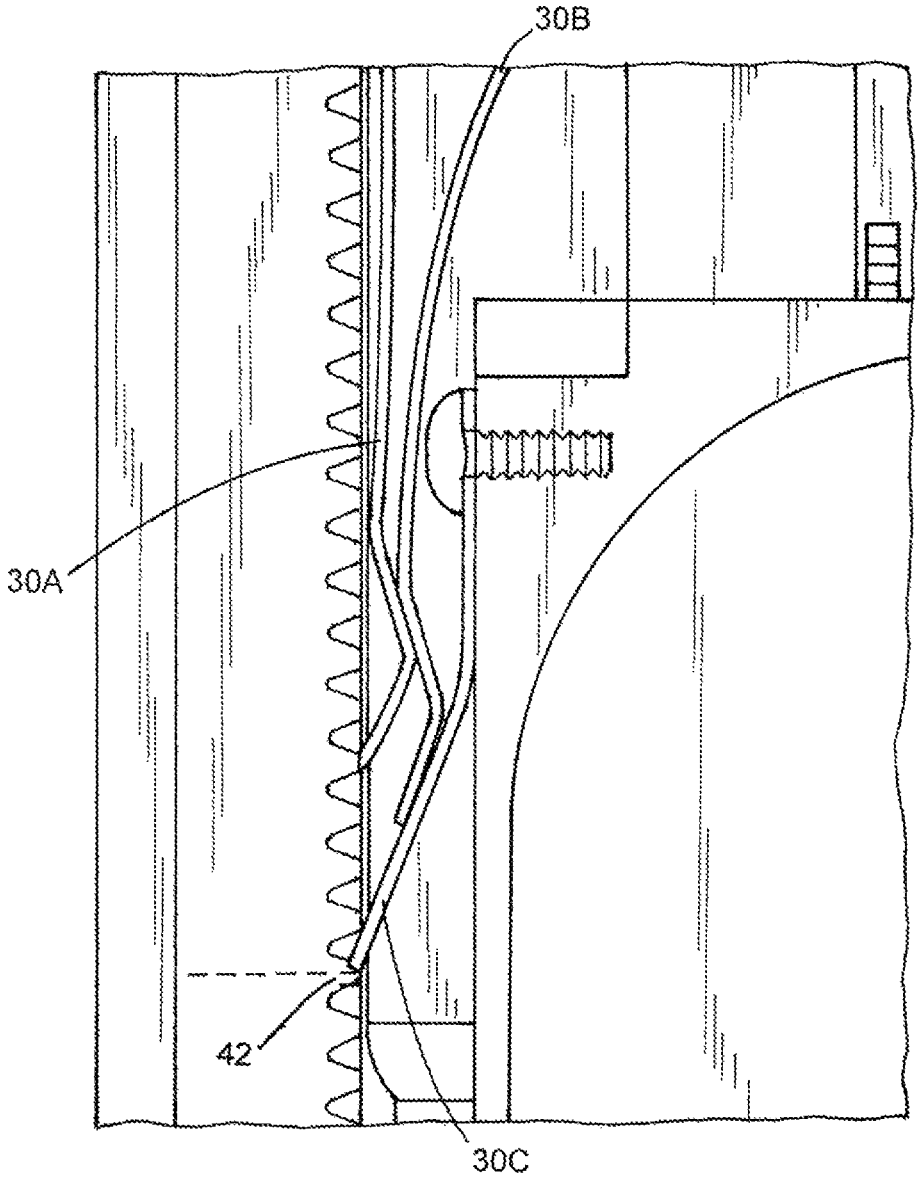

FIG. 9 illustrates spring 30B partially displaced by the thrusting force applied by the attached lever arm, with the flexing end of spring 30A being displaced to the left and with spring 30B touching the flexing end of spring 30C. Once spring 30C disengages from the proximate one of teeth 42, plunger 40 will be free to move upward due to the force of the attached plunger spring.

Figure 10:
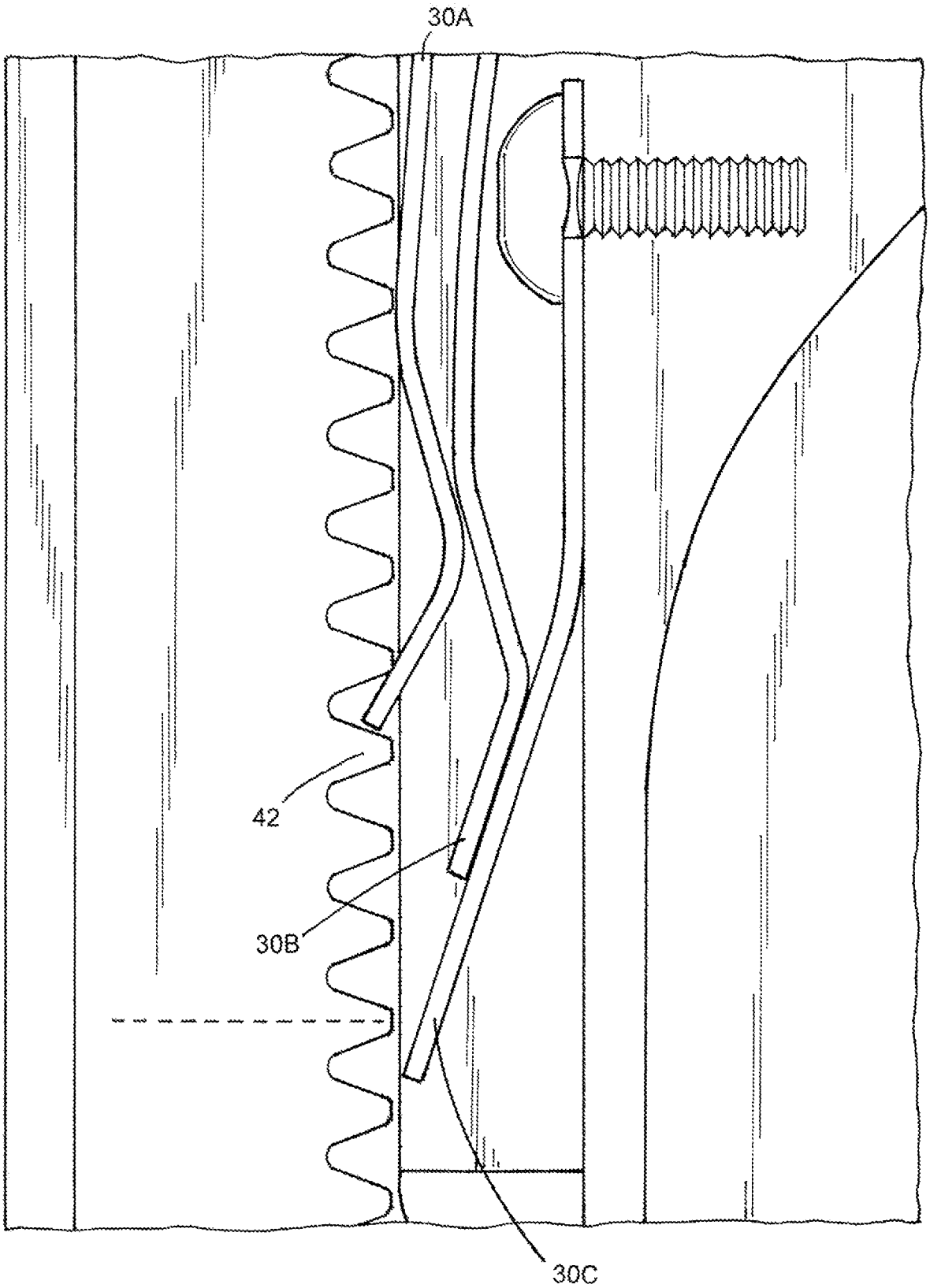

FIG. 10 illustrates spring 30B fully displaced by the thrusting force applied by the attached lever arm, with the flexing end of spring 30A displaced to the left and engaged with one of teeth 42. One can see by the indexed one of teeth 42 that the plunger has been permitted to extend or move upward by one tooth width.

Figure 11:
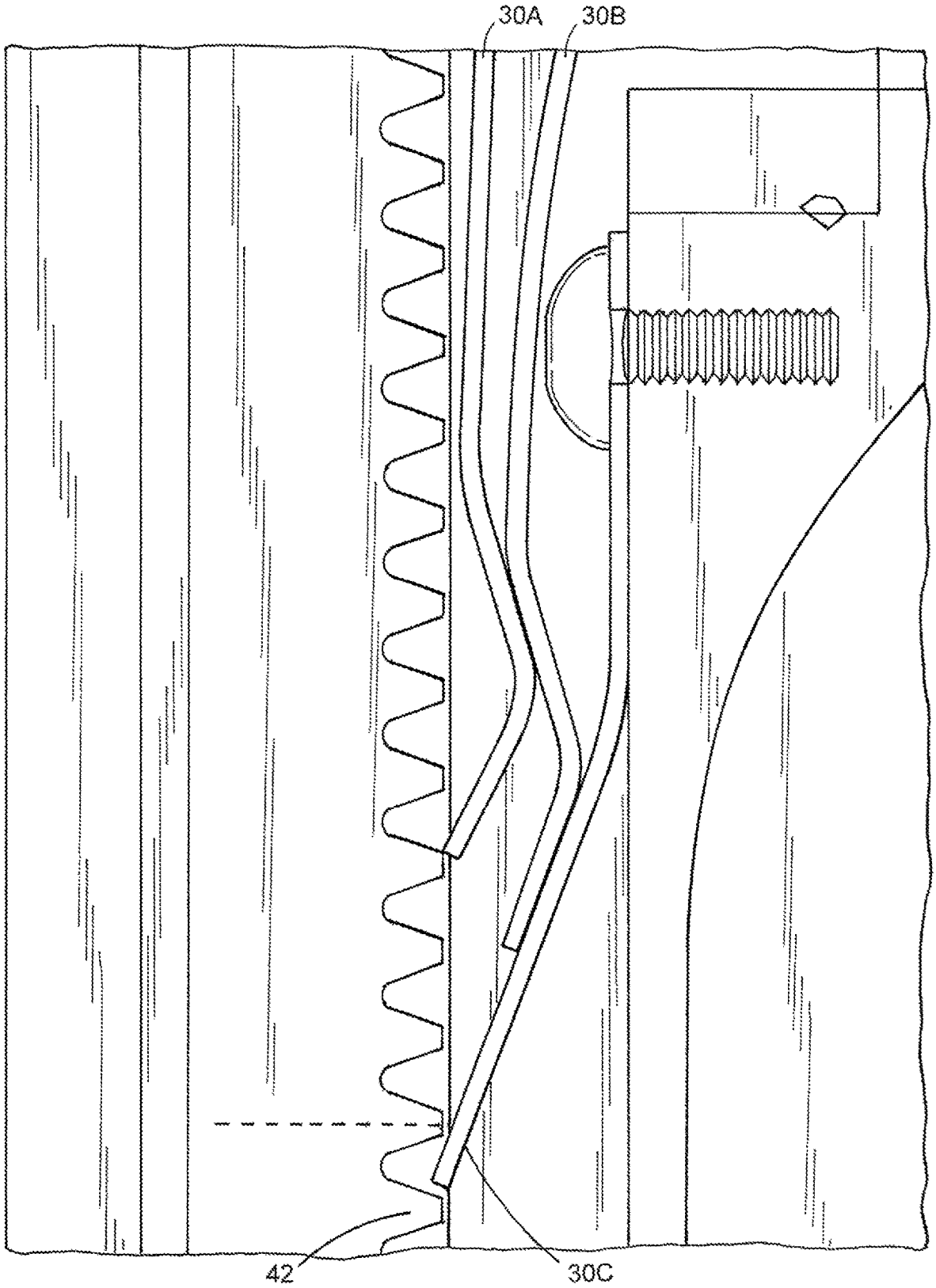

FIG. 11 illustrates spring 30B transitioning back to the relaxed state illustrated in FIG. 8. As spring 30B retracts, spring 30C returns back to its initial position and grips to another one of teeth 42. Additionally, spring 30A begins to retract and lose its grip upon the proximate one of teeth 42.

FIGS. 8-11 illustrate movement of plunger 40 by one tooth width. In one embodiment, plunger 40 can include a space free of teeth 42, such that when spring 30C reaches the space free of teeth, plunger 40 will surge upward for some length greater than one tooth width, for example, causing spring catch 45 to quickly extend some desired distance above simulation magazine 10.

Figure 12:
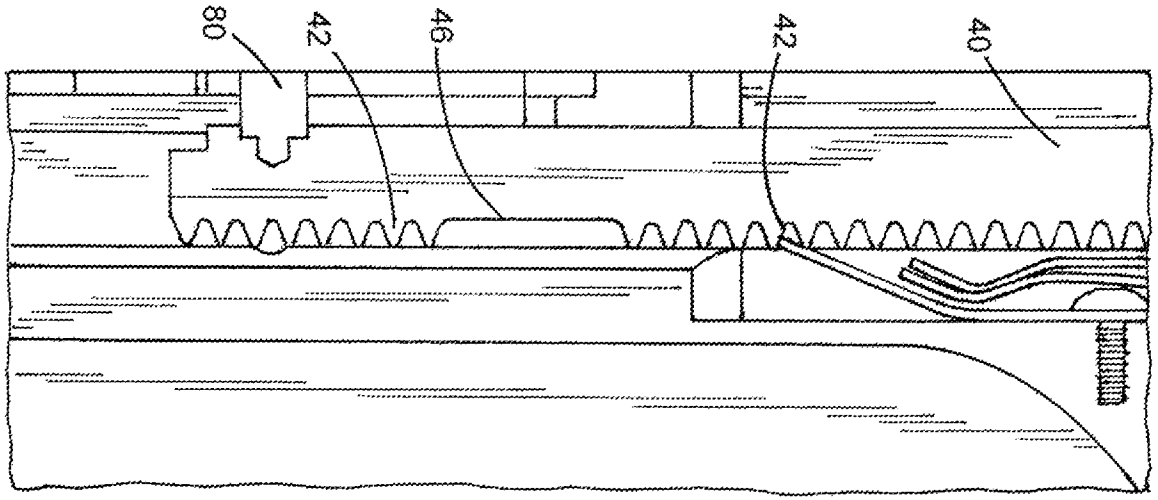
FIG. 12 illustrates a round counting plunger including a teeth gap useful to cause the plunger to extend into a slide open state and including a plunger depression button, in accordance with the present disclosure.

FIG. 12 illustrates a round counting plunger including a teeth gap useful to cause the plunger to extend into a slide open state and including a plunger depression button. Plunger 40 is illustrated including upper teeth 42 configured to interact with spring assembly 30. Lower teeth 42 are optional and provide a method to attach plunger depression button 80 to the plunger. In place of the lower teeth, some other mechanical attachment could be used between the button 80 and the plunger 40. Teeth gap 46 permits the plunger 40, when the tooth just above the gap cycles through the lowest spring, to move dramatically upward. This large movement causes a top end of the plunger 40 to extend up significantly from a top of the simulation magazine. This extension upward catches the slide and causes the slide to stay in the open position.

Figure 13:
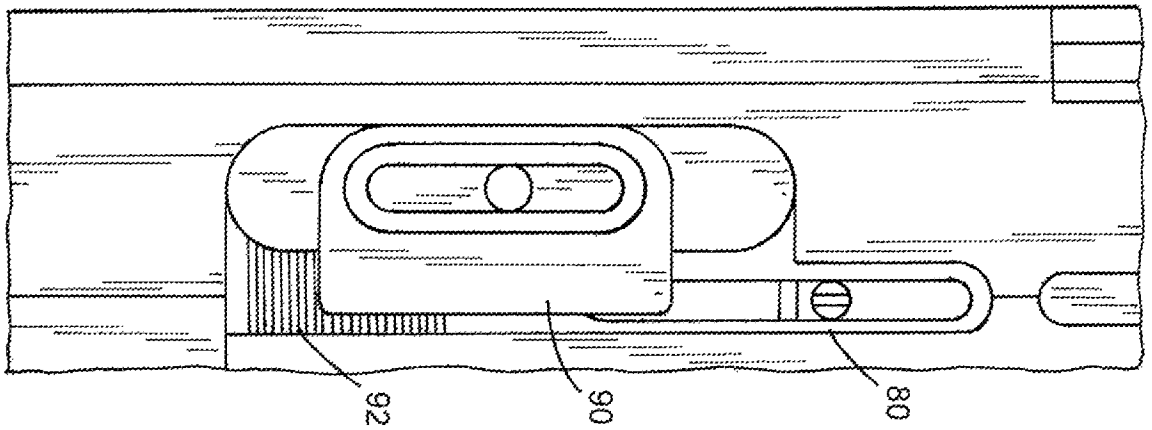
FIG. 13 illustrates a round count simulation limiter positioned to stop a plunger depression button from extending past a desired level, thereby simulating a number of initial rounds in the magazine, in accordance with the present disclosure.

FIG. 13 illustrates a round count simulation limiter positioned to stop a plunger depression button from extending past a desired level, thereby simulating a number of initial rounds in the magazine. Limiter 90 is illustrated affixed to an outer surface of the magazine. It is held in place by a screw after being aligned to a series of ridges 92 formed in the outer surface of the magazine. Button 80 can only be depressed until it contacts the upper surface of limiter 90. By positioning limiter 90 on the outer surface according to a vertical location corresponding to a desired maximum number of rounds in the magazine, as represented by ridges 92 or other markings, the magazine can be set to simulate a certain number of rounds fired in the simulation before the slide is locked in the open position.

Figure 14:
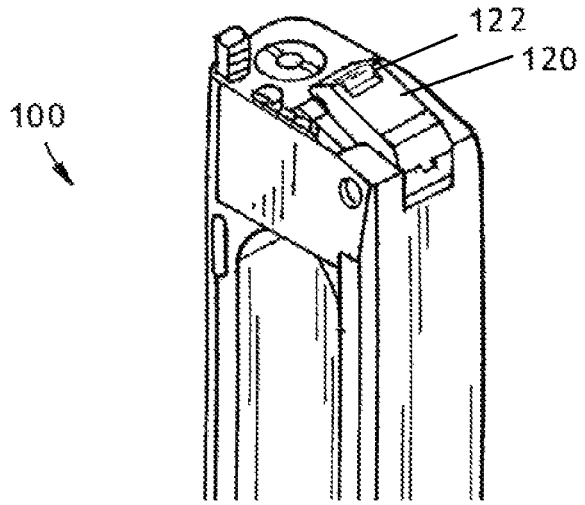
FIG. 14 illustrates an alternative exemplary embodiment to the simulation magazine of FIG. 1, with an optional roller bearing upon an upper surface of the lever arm, in accordance with the present disclosure.

FIG. 14 illustrates an alternative exemplary embodiment to the simulation magazine of FIG. 1, with an optional roller bearing upon an upper surface of the lever arm. Simulation magazine 100 is illustrated including lever arm 120. Lever arm 120 comes into contact with the slide or details attached to the slide of the firearm in which magazine 100 is used. The slide, when cycled, moves very quickly back and forth over lever arm 120. A roller bearing 122 is illustrated fitted to and providing rolling contact between lever arm 120 and neighboring slide details. In this way, wear and tear upon both the lever arm and the slide details of the firearm are reduced. Roller bearing 122 can be in one example a cylindrical roller configured to roll in a direction forward and backward in relation to a forward and rearward direction in which the simulation magazine sits within a firearm.

The springs illustrated in the various figures are one way to transform a depression of lever arm 20 into a graduated or step release of plunger 40. Other similar spring assemblies with more or fewer springs or ratcheting mechanisms can similarly be used to translate a single depression of lever arm 20 into an incremental release of the plunger into a more upward state. The disclosure is not intended to be limited to the particular exemplary embodiments of the spring mechanisms and graduated tooth release mechanisms described herein.]

In one alternative embodiment, the mechanical springs can be replaced with an electronic sensor and solenoid mechanism or mechanisms to permit the plunger to incrementally travel upward. Such an embodiment can use the solenoid inputs to "walk" the teeth of the plunger upward one tooth at a time. A similar embodiment can use a toothed gear attached to an electric motor to incrementally move the plunger upward, with a gap in the teeth of the plunger combined with the plunger spring still affecting the desired rapid movement of the plunger into the upward state. In another embodiment, release of the plunger into the upward state may not cause the plunger to extend upwardly from the magazine, but may instead cause a separate spring loaded plunger, perhaps with a stronger spring, to rapidly thrust upward.

Figure 15:
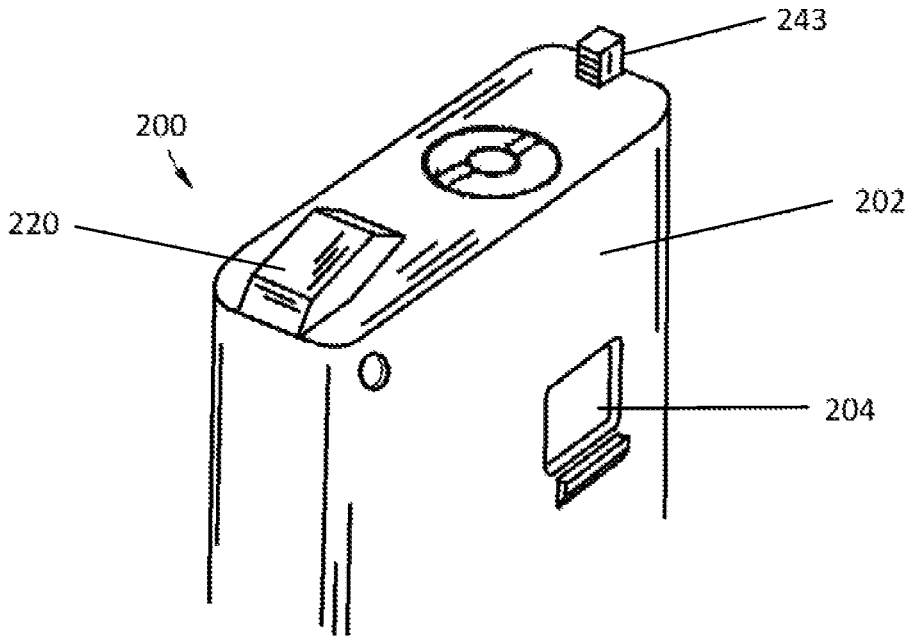
FIG. 15 illustrates an alternative exemplary embodiment to the simulation magazine of FIG. 1, configured for use within an exemplary rifle, in accordance with the present disclosure.

The disclosed simulation magazine is useful in handguns or rifles. FIG. 15 illustrates an alternative exemplary embodiment to the simulation magazine of FIG. 1, configured for use within an exemplary rifle. An exemplary AR-15 rifle includes a bolt catch mechanism which under normal operation of the rifle engages with a bolt carrier mechanism after a last round in the magazine is fired, the bolt catch holding the bolt carrier in a rearward position until a user presses upon the bolt catch mechanism lever to release the bolt carrier forward. FIG. 15 illustrates simulation magazine 200 including magazine body 202 configured to fit within a magazine cavity of an exemplary AR-15 rifle and magazine catch detent 204 configured to enable the magazine to be engaged to the rifle. Simulation magazine 200 includes cycling lever arm 220 connected through internal springs to linear plunger 240 which includes an end that can extend upwardly from magazine body 202 to interact with the bolt catch mechanism of the rifle, with the up position for plunger 240 causing the rifle's bolt catch to selectably lock the bolt carrier of the rifle in a rearward position. An end of the plunger 240 can act as a bolt catch or bolt catch trigger, or plunger 240 in an alternative configuration can act upon another lever arm or detent arm to act upon a proximate bolt or bolt carrier. Similar configurations can be used with other rifles which include a bolt catch useful to hold a bolt or bolt carrier in an open or rearward position after a last round is fired from a magazine, including but not limited to exemplary AK-47 rifles, FN FAL rifles, MIA rifles, and Ruger® 10/22 rifles. Similarly, semi-automatic shotguns utilizing a magazine and a bolt catch, such as exemplary Kalashnikov® USA Shotgun 3" 12 gauge shotgun and Saiga® semi-automatic 12 gauge shotgun, can use simulation magazines in accordance with the disclosure.

The disclosure has described certain preferred embodiments and modifications of those embodiments. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. An apparatus comprising a simulated magazine useful to provide for simulated firing of a firearm, comprising:

a cycling lever arm which is depressed once every time the firearm is cycled;

a linearly shaped counting plunger;

a plunger spring biasing the plunger in an upward position; and a spring assembly connected to the cycling lever arm and acting upon the plunger;

wherein depression of the cycling lever arm causes the plunger to move incrementally upward;

wherein, when the plunger is in a fully up state, the plunger causes a slide catch trigger to extend upward, causing a slide of the firearm to remain in a back, open state; and wherein the linearly shaped counting plunger comprises a plurality of teeth.

2. The apparatus of claim 1, further comprising a round count simulation limiter attached to an exterior of the magazine enabling a specific number of initial rounds for simulation.

3. The apparatus of claim 1, wherein the slide catch trigger comprises an upper end of the linearly shaped counting plunger.

4. The apparatus of claim 1, wherein the spring assembly comprises:

a first spring anchored to a housing of the simulated magazine at a first end and comprising a flexible second end;

a third spring anchored to a housing of the simulated magazine at a first end and comprising a flexible second end;

a second spring attached to the cycling lever arm at a first end, wherein a second end of the second spring is between the first spring and the third spring;

wherein depression of the cycling lever arm causes the plunger to move incrementally upward by causing the second end of the first spring and the flexible end of the third spring to shift upon the teeth of the linearly shaped counting plunger.

5. The apparatus of claim 4, wherein the linearly shaped counting plunger further comprises a teeth gap.

6. The apparatus of claim 1, wherein the cycling lever arm comprises a roller bearing.

7. An apparatus comprising a simulated magazine useful to provide for simulated firing of a firearm, comprising:

a cycling lever arm which is depressed once every time the firearm is cycled;

a linearly shaped counting plunger;

a plunger spring biasing the plunger in an upward position; and a spring assembly connected to the cycling lever arm and acting upon the plunger;

wherein depression of the cycling lever arm causes the plunger to move incrementally upward;

wherein, when the plunger is in a fully up state, the plunger causes a bolt catch trigger to extend upward, causing one of a bolt and a bolt carrier of the firearm to remain in a back, open state; and wherein the linearly shaped counting plunger comprises a plurality of teeth.

8. The apparatus of claim 7, further comprising a round count simulation limiter attached to an exterior of the magazine enabling a specific number of initial rounds for simulation.

9. The apparatus of claim 7, wherein the bolt catch trigger comprises an upper end of the linearly shaped counting plunger.

10. The apparatus of claim 7, wherein the spring assembly comprises:

a first spring anchored to a housing of the simulated magazine at a first end and comprising a flexible second end;

a third spring anchored to a housing of the simulated magazine at a first end and comprising a flexible second end;

a second spring attached to the cycling lever arm at a first end, wherein a second end of the second spring is between the first spring and the third spring;

wherein depression of the cycling lever arm causes the plunger to move incrementally upward by causing the second end of the first spring and the flexible end of the third spring to shift upon the teeth of the linearly shaped counting plunger.

11. The apparatus of claim 10, wherein the linearly shaped counting plunger further comprises a teeth gap.

12. The apparatus of claim 7, wherein the cycling lever arm comprises a roller bearing.

13. An apparatus comprising a simulated magazine useful to provide for simulated firing of a firearm, comprising:

a cycling lever arm which is depressed once every time the firearm is cycled;

a linearly shaped counting plunger comprising a plurality of teeth;

a plunger spring biasing the plunger in an upward position; and a spring assembly connected to the cycling lever arm and acting upon the plunger, the spring assembly comprising:

a first spring anchored to a housing of the simulated magazine at a first end and comprising a flexible second end;

a third spring anchored to a housing of the simulated magazine at a first end and comprising a flexible second end;

a second spring attached to the cycling lever arm at a first end, wherein a second end of the second spring is between the first spring and the third spring;

wherein depression of the cycling lever arm causes the plunger to move incrementally upward by causing the second end of the first spring and the flexible end of the third spring to shift upon the teeth of the linearly shaped counting plunger;

wherein, when the plunger is in a fully up state, a top of the plunger extends upward from the magazine in a open-slide state.

* * * * *